United States Patent [19]

Bills et al.

[11] Patent Number: 4,708,222

[45] Date of Patent: Nov. 24, 1987

[54] PROTECTIVE ELEVATOR SYSTEMS

[75] Inventors: Randall C. Bills, Richardson; Teddy E. Bumgardner, Irving; Lusbert L. Monroe, Dallas; Jeffery D. Zimmermann, Garland, all of Tex.

[73] Assignee: Beltway Construction, Inc., Dallas, Tex.

[21] Appl. No.: 854,591

[22] Filed: Apr. 22, 1986

[51] Int. Cl.[4] ..... B66B 9/00

[52] U.S. Cl. ..... 187/1 R; 160/135; 160/351; 52/239

[58] Field of Search ..... 187/1 R; 160/351, 352, 160/135; 135/109, 111, 116; 52/239, 238.1, 70, 71, 65; 105/463.1

[56] References Cited

U.S. PATENT DOCUMENTS

| | | | |
|---|---|---|---|
| 3,173,436 | 3/1965 | Peters | 135/109 |
| 3,709,237 | 1/1973 | Smith | 160/135 |
| 3,913,598 | 10/1975 | Glutting, Jr. et al. | 160/135 |
| 4,161,850 | 7/1979 | Peterson et al. | 160/351 |
| 4,194,313 | 3/1980 | Downing | 160/135 |

FOREIGN PATENT DOCUMENTS

| | | | |
|---|---|---|---|
| 648472 | 3/1964 | Belgium | 187/1 R |
| 528142 | 10/1940 | United Kingdom | 160/351 |
| 2081337 | 2/1982 | United Kingdom | 160/351 |
| 2139183 | 11/1984 | United Kingdom | 187/1 R |

*Primary Examiner*—Joseph J. Rolla
*Assistant Examiner*—Kenneth Noland
*Attorney, Agent, or Firm*—Richards, Harris, Medlock & Andrews

[57] ABSTRACT

A collapsible portable protective wall system for use in protecting the interior surfaces of elevators. The system comprises an articulated backwall and articulated sidewalls hingedly connected to the ends of the backwall. The backwall comprises a central base panel and at least two hingedly connected wing panels. Each sidewall has at least two wall panels hingedly connected to each other. The outer surfaces of the protective system is provided with a padding material such as carpeting or the like to avoid abrasion of the interior elevator surfaces. The system may be inserted into an elevator interior in the folded compact position in which the padded surfaces are exposed. It can then be unfolded to conform generally with the elevator walls so that the padded outer surfaces of the wall panels are exposed to the interior elevator surfaces, thus minimizing the possibility of damage during installation.

15 Claims, 2 Drawing Figures

PROTECTIVE ELEVATOR SYSTEMS

TECHNICAL FIELD

This invention relates to systems for the protection of the interior surfaces of elevator cabs and more particularly to protective wall systems which can be readily inserted into and removed from elevator interiors.

BACKGROUND OF THE INVENTION

Elevator shafts occupy a substantial portion of the space available in multi-level buildings. Many multi-level buildings, particularly midrise office buildings and apartment buildings, do not have elevators exclusively for the transportation of freight, furniture, construction materials and the like to upper levels within the building. Absent such dedicated elevators, elevators normally used for passenger service are temporarily converted for the purpose of hauling freight, furniture, etc.

In many cases, such passenger elevators have expensive and sometimes delicate interior wall finishes and also floor coverings which are subject to damage when transporting freight. In this case it is a conventional practice to provide temporary protective materials. Probably the most common method of protecting elevator interiors involves the use of removable fabric pads or mats. These pads typically are hung on wall hooks that are permanently installed around the interior of the elevator cab. These pads, however, are relatively thin to avoid bulk which would prove unwieldy and thus provide only limited protection against impact. They soil easily and are subject to tearing so that the interior elevator surface may still be subject to abrasion, scratching and the like. The parameter hooks required for installation of the pads are unsightly and thus many elevators are not provided with such hooks making the use of pads even more unreliable. Elevators pads, of course, do not provide any protection for the floor of the elevator.

Another possibility resides in the use of plywood panels which are installed around the elevator cab interior. The use of such panels is disadvantageous in that they cannot be easily removed and reinstalled. The installation of such panels is relatively labor intensive and requires the expenditure of time by a skilled workman to accomplish the measuring, cutting and installation of the panels.

DISCLOSURE OF THE INVENTION

In accordance with the present invention, there is provided a portable protective wall system for use in the interiors of elevators which can be readily installed and removed without the need for skilled workmen and which can be readily transported from one elevator to the next. The protective wall system of the present invention comprises an articulated backwall and articulated sidewalls which are hingedly connected to the opposed ends of the backwall. The articulated backwall comprises at least two wing panels hingedly connected to a central base panel preferably of a width to accommodate the wall structure in the folded retracted position and to provide substantial stability for ready movement of the retracted assembly from one position to another. Each of the sidewalls has at least two wall panels hingedly connected to one another. The sidewall panels which are in proximity to the backwall, when in a folded position, fold inwardly toward each other and against the front surface of the backwall. The wing panels receive the adjoining sidewall panels and they are folded together so that when the protective wall system is in its retracted compact position, the sidewalls and backwall panels are in a compact juxtaposed relationship.

The wall panels are formed of a structurally rigid material such as plywood or the like and preferably are provided with padding material on the outside surfaces. Preferably the backwall and sidewall panels are articulated with respect to one another so that when the protective wall system is folded into a retracted compact assembly, the surfaces of the wall panels which are then exposed are padded.

BEST MODES FOR CARRYING OUT THE INVENTION

Figure 1:
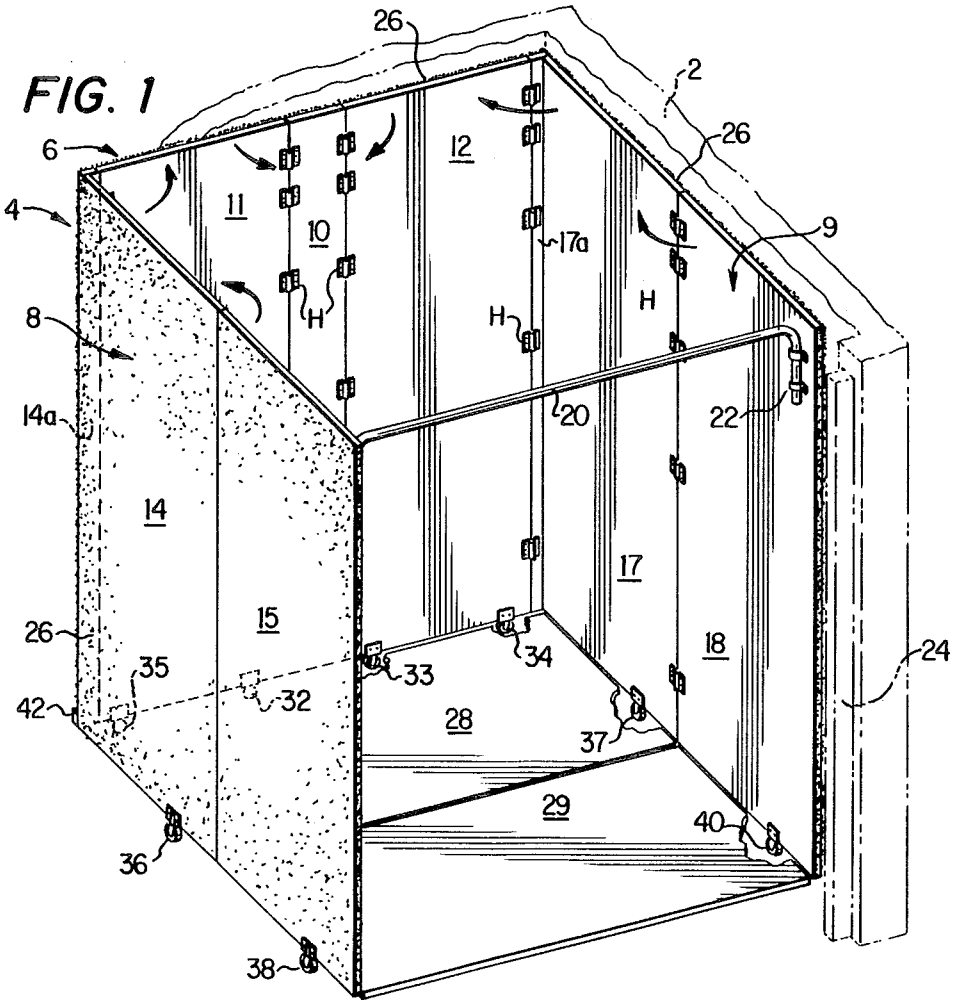
FIG. 1 is a perspective view showing the protective wall system of the present invention in place within an elevator cab.

FIG. 1 illustrates the protective wall system of the present invention in an expanded configuration and placed to protect the finished interior surfaces of an elevator cab as indicated generally by reference numeral 2 in only portions of the back and one side of the interior wall surfaces of the elevator are shown in order to facilitate illustration of the protective system itself.

The protective wall system 4 comprises an articulated backwall 6 and articulated sidewalls 8 and 9. The backwall portion comprises a relatively narrow central base panel 10 to which wing panels 11 and 12 are secured by means of hinges H.

The sidewalls hingedly connected to the backwall portion are similarly composed of wall panels which are hingedly connected to one another to provide an articulated structure. Thus, sidewall 8 is composed of wall panels 14 and 15 and sidewall 9 composed of similar wall panels 17 and 18.

The hinges connecting the various wall segments are generally designated by the legend H and preferably are, in every case, located on the interior of the protective wall system as shown in order to facilitate folding of the various wall panels in the direction indicated by the arrows. This arrangement of the hinges not only avoids a hinge structure on the exterior of the system where it might scratch the elevator interior surfaces, but also facilitates the insertion and withdrawal of the protective wall system in a manner to minimize the likelihood of damage to the interior wall surfaces of the elevator.

A removable strut 20 is interposed between the sidewalls of the protective wall system to hold it in the expanded position. As illustrated, the panel retainer or strut is simply a rigid compression bearing member which is held in place by any suitable means such as fits into holders 22 on each of wall panels 15 and 18. The strut member is located near the top of the assembly so that when the elevator door, indicated schematically by reference character 24, is open to provide access to the interior of the elevator, entry into the compartment formed by the protective wall structure is unimpeded.

The panel members may be formed of any suitable rigid structure material such as plywood, hardboard or the like. The outer surfaces of the sidewall and the backwall panels are provided with a shock absorbant protective material 26 which will not scratch the interior elevator surfaces. The protective material may take the form of a padding such as provided by carpeting and the like which is simply glued onto the wall panels. Floor panels 28 and 29 formed of plywood or the like may be placed directly on the elevator floor in order to provide additional protection. The floor panels may be provided with carpeting and the like on their bottom surfaces although usually the elevator floor surface will be such that such additional padding is not needed and the plywood surface itself is adequate.

The hinges H connecting the several wall segments preferably are located on the interior of the protective system not only to reduce the possiblity of damage to the interior elevator surfaces but also to facilitate folding of the several wall panels in the manner indicated by the arrows.

The advantages of this mode of construction is illustrated by the manner of installing and withdrawing the protective wall system. Thus, when it is desired to remove the system from the elevator, the retaining strut 20 and floor panels are removed and the outermost or forward sidewall panels 15 and 18 folded inwardly as indicated by the arrows. The offset sections 14*a* and 17*a* of the rearward panels are of sufficient width to accommodate the thickness of the forward wall panels. After folding the sidewall panels together, the sidewalls 8 and 9 are folded inwardly as indicated by the arrows so that they rest in juxtaposition against the wing panels 11 and 12, respectively. At this point, the backwall wing panels can be folded inwardly toward each other as indicated by the arrows to arrive at the compact folded assembly indicated by FIG. 2.

This particular arrangement for articulating the sidewall and backwall panels is advantageous in that the protective wall assembly can be easily set in place within the elevator in the collapsed position and then sequentially unfolded in a manner such that padded outer surfaces are always exposed to the elevator interior surfaces, thus minimizing the likelihood of damage during installation. The same is also true during withdrawal as evident from the foregoing description.

The protective wall system is provided with roller means on at least some of the wall panels in order to facilitate movement of the assembly from one location to the other. The dimensional relationship of the central base panel 10 is important not only in the sense of providing a width sufficient to accommodate the thickness of the wall panels in the collapsed position, but also to provide stability to the protective wall system when in this position. Preferably, the roller means for the protective wall system comprises at least one caster for each wall panel including casters 32 and 33 on the wing panels near the hinged connection of the wing panels to the central base panel. Casters are preferably also provided on the wing panels near the ends thereof as indicated by reference numerals 34 and 35 and on the inner or rearward wall panels 14 and 17 as indicated by reference numerals 36 and 37 near the ends thereof. Casters 38 and 40 are provided near the outer ends of panels 15 and 18.

Figure 2:
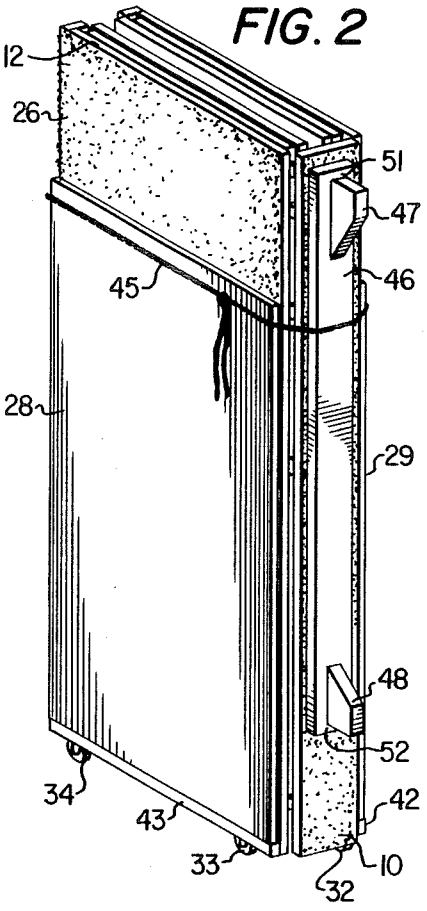
FIG. 2 is a perspective view showing the protective wall system in a retracted position where it forms a compact assembly that is easily movable from one location to another.

In a further aspect of the invention, at least two of the wall panels are provided with lower shoulders in order to support the detachable floor panels when the protective wall system is in the folded position. Preferably, in the arrangement providing for relative articulated motion of the panels as illustrated in FIG. 1, the outer surfaces of the wing panels are provided with such shoulders as indicated by references numerals 42 and 43. As shown in FIG. 2, the wall panels are supported on the shoulders 42 and 43 and held in place on the assembled structure by means of a rope 45 or the like. When the protective wall system is transported to a new location, the floor panels of course are removed from the collapsed assembly prior to insertion of the assembly into the elevator in order to minimize the likelihood of damage. While the protective wall system can be unfolded prior to insertion into the elevator, it is preferable to simply move the structure in a folded position (floor panels removed) into place with the central base panel against the backwall of the elevator. The assembly can then be progressively unfolded while at all times exposing the interior elevator surfaces only to the padded panel surfaces, thus minimizing the likelihood of damage.

The advantages of the relationship of casters can be seen by reference to FIG. 2 whereby the casters when in the folded position are sufficiently spaced to provide a relatively stable structure for transportation of the system from one location to another. Thus, the central base panel 10 is of a sufficient width to provide a distance between casters 32 and 33 on at one end of the folded assembly and casters 34 and 35 (not shown in FIG. 2) at the other end of the assembly so that the protective wall system can be readily moved about without tipping it over. FIG. 2 also illustrates an alternative of form panel retaining strut indicated by reference numeral 46. As there shown, the wooden strut member is provided with abutment means 47 and 48 spaced slightly inwardly from the ends of the main strut portion 50 to provide shoulders at each end as indicated by reference numerals 51 and 52. Thus, when the strut members are in place, the shoulders 51 and 52 rest upon the upper edges of the wall panels and the outer surfaces of the abutment members rest against the inner surfaces of the wall panels to hold the assembly in the open position.

In the embodiment illustrated, the segmented backwall and sidewall panels are composed of two primary wall panels and this usually will be sufficient. However, it will be recognized that structures suitable for use in unusually large elevators can be formulated with more than two panels. For example, the sidewalls can be formed in three articulated sections, each preferably folding inwardly upon the next in a manner similar to that shown by the arrows in FIG. 1.

Although several embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

We claim:

1. In a protective wall system for use in elevators, the combination comprising:

(a) an articulated backwall comprising structurally rigid panels including a central base panel and at least two wing wall panels hingedly connected to said base panel, the width of said base panel being substantially less then the width of said wing panels;

(b) first and second articulated sidewalls hingedly connected to the opposed ends of said backwall;

(c) the articulated backwall and the sidewalls of the protective wall system laying in a proximate contiguous relationship with adjacent interior surfaces of an elevator structure;

(d) each of said sidewalls having structurally rigid panels including at least two wall panels hingedly connected to one another, the rearward wall panels in closest proximity to said backwall, when in the open position, folding inwardly toward each other and against the front surface of said backwall; and (e) said wing panels of said backwall each adapted to receive one of said sidewalls with the wall panels thereof folded together whereby said protective wall system can be folded into a compact position in which said folded sidewalls and said backwall wing panels are in juxtaposition.

2. The combination of claim 1 wherein the forward wall panels of said sidewalls fold inwardly with respect to the rearward wall panels.

3. The combination of claim 1 further comprising padding material on the outside surfaces of said sidewalls and said backwall.

4. The combination of claim 3 wherein said backwall panels and said sidewall panels are articulated with respect to one another so that when said protective wall system is folded into its compact position, the exposed surfaces of said wall panels are padded.

5. The combination of claim 1 further comprising lower roller means on the bottom of at least some of said panels to facilitate movement of said protective wall system in the compact position.

6. The combination of claim 5 wherein said roller means includes at least two spaced apart casters on the said backwall in close proximity to the hinged connections of said wing panels to said central base panel.

7. In a protective wall system adapted for use in elevators, the combination comprising:

(a) an articulated backwall comprising a central base panel and at least two wing wall panels hingedly connected to said base panel, the width of said base panel being substantially less than the width of said wing panels and of a width sufficient to accommodate said sidewall panels and said rear wall wing panels when said system is in the collapsed position;

(b) first and second articulated sidewalls hingedly connected to the opposed ends of said backwall;

(c) each of said sidewalls having at least two wall panels hingedly connected to one another, the rearward wall panels in closest proximity to said backwall, when in the open position, folding inwardly toward each other and against the front surface of said backwall; and (d) said wing panels of said backwall each adapted to receive one of said sidewalls with the wall panels thereof folded together whereby said protective wall system can be folded into a compact position in which said folded sidewalls and said backwall wing panels are in juxtaposition.

8. The combination of claim 7 comprising a plurality of casters to support said backwall and sidewalls including a caster on each of said wing panels near said base panel and a caster on each of said sidewall panels.

9. The combination of claim 8 wherein said casters include a caster on each of said back wing panels at a location near the ends thereof.

10. In a building elevator temporarily modified for the carrying of freight and the like, the combination comprising:

(a) an elevator structure having a floor and interior wall surfaces on the back and sides thereof and a front opening providing access to the interior of said elevator structure;

(b) a protective wall system disposed within the interior of said elevator, said protective wall system comprising an articulated backwall and articulated sidewalls, each of said backwall and sidewalls comprising at least two vertical wall panels laying in a proximate contiguous relationship with the adjacent interior surfaces of said elevator structure;

(c) padding material disposed on the outside surfaces of said backwall and sidewalls to avoid damage to the interior surfaces of said elevator by said protective system; and (d) means hingedly connecting the panels of said backwall and sidewalls together whereby said panels may be folded together in juxtaposition to provide a compact assembly for removal from said elevator.

11. The combination of claim 10 further comprising roller means on the bottom of said protective wall system to facilitate withdrawal of said protective wall system from the interior of said elevator.

12. The combination of claim 11 further comprising removable protective floor panels on the floor of said elevator.

13. The combination of claim 12 further comprising lower shoulders on at least two of said wall panels adapted to support said floor panels when said protective wall system has been folded into a collapsed position.

14. The combination of claim 10 further comprising removable strut means interposed between the sidewalls of said protective wall systems to hold said system in the expanded position.

15. In a protective wall system adapted for use in elevators, the combination comprising:

(a) an articulated backwall comprising a central base panel and at least two wing wall panels hingedly connected to said base panel, the width of said base panel being substantially less then the width of said wing panels;

(b) first and second articulated sidewalls hingedly connected to the opposed ends of said backwall;

(c) each of said sidewalls having at least two wall panels hingedly connected to one another, the rearward wall panels in closest proximity to said backwall, when in the open position, folding inwardly toward each other and against the front surface of said backwall;

(d) lower shoulders on at least two of said wall panels providing means to support detachable floor panels when said wall system is in the folded position; and (e) said wing panels of said backwall each adapted to receive one of said sidewalls with the wall panels thereof folded together whereby said protective wall system can be folded into a compact postion in which said folded sidewalls and said backwall wing panels are in juxtaposition;

(f) said lower shoulders being of a size and strength to support said detachable floor panels made of plywood.

* * * * *